US005669044A

United States Patent [19]

Cuthbert

[11] Patent Number: 5,669,044

[45] Date of Patent: Sep. 16, 1997

[54] ARTICLE AND METHOD FOR DISPENSING TONER AND THE LIKE

[75] Inventor: Laura Cuthbert, Watertown, Mass.

[73] Assignee: Nashua Corporation, Nashua, N.H.

[21] Appl. No.: 786,413

[22] Filed: Jan. 21, 1997

Related U.S. Application Data

[63] Continuation of Ser. No. 481,764, Jun. 7, 1995, abandoned.

[51] Int. Cl.[6] ..... G03G 15/08

[52] U.S. Cl. ..... 399/120; 399/262

[58] Field of Search ..... 399/120, 262

[56] References Cited

U.S. PATENT DOCUMENTS

| | | |
|---|---|---|
| 143,323 | 9/1873 | Bradford . |
| 604,937 | 9/1898 | Irish . |
| 753,729 | 3/1904 | Oates . |
| 1,485,222 | 2/1924 | Ginty . |
| 1,822,557 | 9/1931 | Beatton . |
| 1,964,176 | 6/1934 | Root . |
| 2,100,216 | 11/1937 | Hughes . |
| 2,337,161 | 12/1943 | Hessert . |
| 2,367,585 | 1/1945 | Huszar . |
| 2,392,245 | 1/1946 | Huszar . |
| 2,394,453 | 2/1946 | Huszar . |
| 2,436,959 | 3/1948 | Ekin et al. . |
| 2,534,782 | 12/1950 | Maddux . |
| 2,720,340 | 10/1955 | Custafson . |
| 2,722,357 | 11/1955 | Whitecar . |
| 2,965,266 | 12/1960 | Rutkus, Jr. et al. . |
| 3,122,277 | 2/1964 | Kline . |
| 3,147,956 | 9/1964 | Phillips . |
| 3,259,372 | 7/1966 | Phillips . |
| 3,269,707 | 8/1966 | Phillips . |
| 3,325,844 | 6/1967 | Lampe . |
| 3,526,341 | 9/1970 | Johnston . |
| 3,589,568 | 6/1971 | Hoelscher . |
| 3,647,293 | 3/1972 | Queener . |
| 3,700,142 | 10/1972 | Waibel . |
| 3,703,360 | 11/1972 | Wilkinson . |
| 3,722,471 | 3/1973 | Stoffel et al. . |
| 3,829,066 | 8/1974 | Phillips . |
| 3,834,808 | 9/1974 | Takahashi et al. . |
| 3,853,246 | 12/1974 | Dubois . |
| 3,901,411 | 8/1975 | Bauman . |
| 3,915,208 | 10/1975 | Anderson ..... 222/DIG. 1 |

(List continued on next page.)

FOREIGN PATENT DOCUMENTS

| | | |
|---|---|---|
| 76 23159 | 2/1977 | France . |
| 27 23 805 C | 3/1980 | Germany . |
| 51-15444 | 2/1976 | Japan . |
| 52-130643 | 11/1977 | Japan . |
| 52-138138 | 11/1977 | Japan . |
| 54-39639 | 3/1979 | Japan . |
| 54-59152 | 5/1979 | Japan . |

(List continued on next page.)

OTHER PUBLICATIONS

IBM Technical Disclosure Bulletin, vol. 17, No. 12, dated May, 1975, p. 3516.

IBM Technical Disclosure Bulletin, vol. 20, No. 11B, dated Apr., 1978, p. 4708.

*Primary Examiner*—Matthew S. Smith

*Attorney, Agent, or Firm*—Hopgood, Calimafde, Kalil & Judlowe

[57] ABSTRACT

An article for dispensing toner and the like to an electrophotographic copier. In accordance with one aspect of the present invention, the article has a generally cylindrical housing with an open end and a closed end, the open end having a flanged collar adjacent thereto. The collar is provided with outwardly extending teeth for enabling the article's rotation upon driving engagement with a dispensing device of the copier. The article open end further comprises a lip and flange portions which loosely secure a ring thereto. Upon mounting the article to the dispensing device, serrated edges about the ring engage a receptacle of the device so as to limit ring movement relative to the receptacle, while allowing rotation of the canister. The ring also has lip portions configured for minimizing spillage of toner, upon removal of the canister from the receptacle.

14 Claims, 12 Drawing Sheets

U.S. PATENT DOCUMENTS

| | | | |
|---|---|---|---|
| 3,915,340 | 10/1975 | Koeleman . | |
| 3,979,026 | 9/1976 | Lee . | |
| 3,999,514 | 12/1976 | Abbott et al. . | |
| 4,018,187 | 4/1977 | Abbott et al. . | |
| 4,026,336 | 5/1977 | Spies . | |
| 4,034,701 | 7/1977 | Davidson et al. . | |
| 4,060,105 | 11/1977 | Feldeisen et al. | 222/DIG. 1 |
| 4,062,385 | 12/1977 | Katusha et al. . | |
| 4,062,476 | 12/1977 | Brand et al. . | |
| 4,089,601 | 5/1978 | Navone . | |
| 4,133,458 | 1/1979 | Rudny . | |
| 4,161,923 | 7/1979 | Abbott et al. . | |
| 4,164,306 | 8/1979 | Perrin . | |
| 4,173,239 | 11/1979 | Reiche . | |
| 4,203,533 | 5/1980 | Zeuthen . | |
| 4,212,264 | 7/1980 | Knechtel et al. . | |
| 4,217,072 | 8/1980 | Boström . | |
| 4,281,918 | 8/1981 | Fortmann . | |
| 4,304,273 | 12/1981 | Caudill et al. . | |
| 4,342,282 | 8/1982 | Yamashita et al. . | |
| 4,344,692 | 8/1982 | Oda . | |
| 4,465,112 | 8/1984 | Kopp . | |
| 4,561,567 | 12/1985 | Wittstein et al. . | |
| 4,603,714 | 8/1986 | Marotta | 141/384 X |
| 4,611,730 | 9/1986 | Ikesue et al. | 222/DIG. 1 |
| 4,615,364 | 10/1986 | Kawata . | |
| 4,641,945 | 2/1987 | Ikesue et al. | 355/245 |
| 4,696,418 | 9/1987 | Kurotaka et al. . | |
| 4,739,907 | 4/1988 | Gallant . | |
| 4,744,493 | 5/1988 | Ikesue et al. | 222/DIG. 1 |
| 4,878,603 | 11/1989 | Ikesue et al. | 222/DIG. 1 |
| 5,259,534 | 11/1993 | Lynd | 141/364 X |
| 5,441,177 | 8/1995 | Yanagisawa | 222/DIG. 1 |
| 5,455,662 | 10/1995 | Ichikawa et al. | 355/245 X |
| 5,500,719 | 3/1996 | Ichikawa et al. | 355/260 |
| 5,516,143 | 5/1996 | Shiotani | 399/120 |

FOREIGN PATENT DOCUMENTS

| | | | |
|---|---|---|---|
| 54-116932 | 9/1979 | Japan . | |
| 54-136337 | 10/1979 | Japan . | |
| 56-147462 | 4/1980 | Japan . | |
| 55-96966 | 7/1980 | Japan . | |
| 55-111978 | 8/1980 | Japan . | |
| 56-40866 | 4/1981 | Japan . | |
| 56-48660 | 5/1981 | Japan . | |
| 0097068 | 6/1983 | Japan | 355/260 |
| 59-12464 | 1/1984 | Japan . | |
| 59-12465 | 1/1984 | Japan . | |
| 59-15954 | 1/1984 | Japan . | |
| 59-188678 | 10/1984 | Japan . | |
| 5061347 | 3/1993 | Japan | 355/260 |
| 6043754 | 2/1994 | Japan | 355/260 |
| 6043755 | 2/1994 | Japan | 355/260 |
| 6266227 | 9/1994 | Japan | 355/260 |
| 6274028 | 9/1994 | Japan | 355/260 |
| 558253 | 5/1977 | U.S.S.R. . | |
| 2833 | of 1911 | United Kingdom . | |
| 1349729 | 4/1974 | United Kingdom . | |
| 1360124 | 7/1974 | United Kingdom . | |
| 1370009 | 10/1974 | United Kingdom . | |
| 1370715 | 10/1974 | United Kingdom . | |
| 1390805 | 4/1975 | United Kingdom . | |
| 1465633 | 2/1977 | United Kingdom . | |
| 1559252 | 1/1990 | United Kingdom . | |

FIG.10A
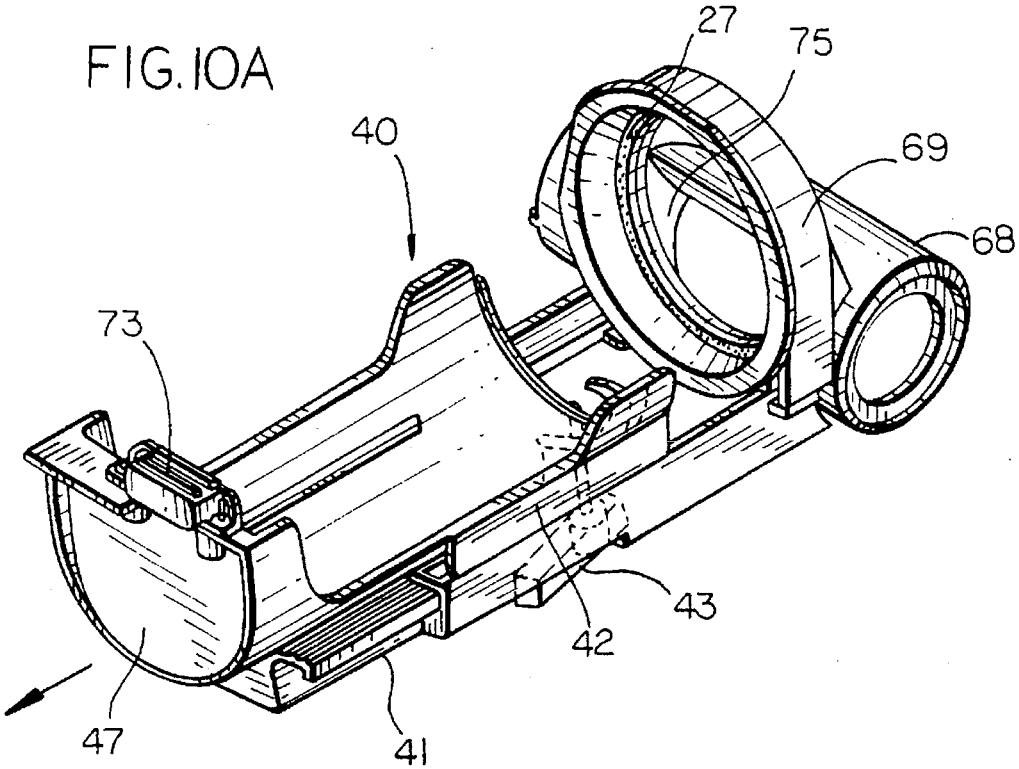
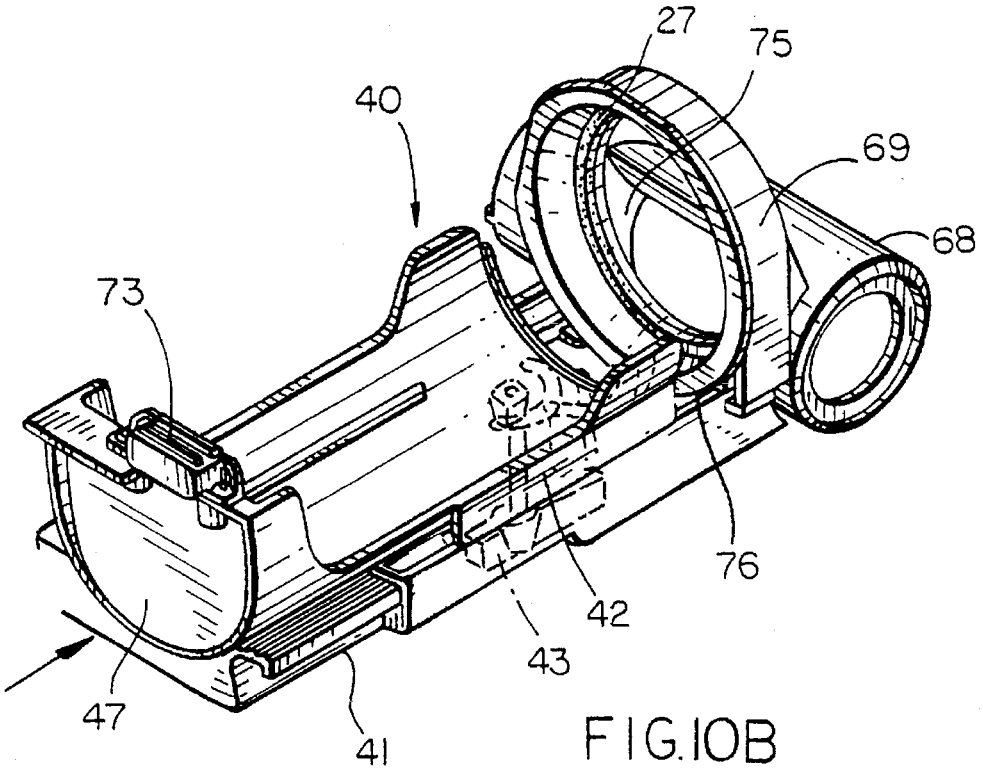
FIG.10B

ARTICLE AND METHOD FOR DISPENSING TONER AND THE LIKE

This application is a continuation of application Ser. No. 08/481,764, filed Jun. 7, 1995, now abandoned.

DISCLOSURE OF THE INVENTION

The present invention relates generally to dispensers of fluids and solids and more particularly to an improved article for dispensing toner and the like.

In an electrophotographic copier, toner is typically dispensed from a removable cartridge. Some cartridges are mounted to a receptacle inside the copier, in a substantially horizontal fashion, and rotated to dispense toner. The receptacle is provided with a synthetic ring, e.g., of polymeric foam, which, upon engagement with the cartridge, abuts a lip at the cartridge entrance for smooth rotating engagement with the receptacle. Upon repeated engagement between the lip and the ring, however, the ring is eventually worn away, causing toner to accumulate about the cartridge opening. When removing the cartridge for recharging or replacement, the accumulated toner often spills from the opening, onto the receptacle and into the copier.

In accordance with one aspect of the present invention there is provided an article for dispensing toner and the like to an electrophotographic copier. The article comprises a generally cylindrical housing with an open end and a closed end, the open end having a flanged collar adjacent thereto. The collar is provided with outwardly extending teeth for enabling the article's rotation upon driving engagement with a dispensing device of the copier. The article open end further comprises a lip and flange portions which loosely secure a ring thereto. Upon mounting the article to the dispensing device, serrated edges about the ring engage a receptacle of the device so as to limit ring movement relative to the receptacle, while allowing rotation of the canister relative to the ring. The ring also has lip portions configured for minimizing spillage of toner upon removal of the canister from the receptacle.

In accordance with another aspect of the present invention is a method of dispensing toner and the like to an electrophotographic copier, the method comprising the steps of:

providing an article having a generally cylindrical housing with an open end and a closed end, the open end having a flanged collar adjacent thereto, the collar including outwardly extending teeth for enabling rotation of the article upon driving engagement with a dispensing device of the copier, and the housing containing a selected volume of toner;

providing a ring in engagement with the open end of the housing, the article open end further comprising a lip and flange portions configured for loosely securing the ring thereto, the ring having serrated edges in non-rotational engagement with a receptacle of the dispensing device and limiting movement of the ring relative to the receptacle, while allowing rotation of the canister, the ring also having lip portions configured for minimizing spillage of toner upon removal of the canister from the receptacle;

rotating the housing so as to dispense the selected volume of toner; and upon delivering substantially the selected volume of toner to the copier, removing the housing from the receptacle.

Accordingly, it is an object of the present invention to provide an article for storing and dispensing toner effectively and economically without spillage upon its removal.

Another object of the present invention is to provide a durable reliable article for dispensing toner which gives lasting service to a copier.

A further object of the present invention is to provide an article which is readily rotatable relative to a ring without rotation relative to a receptacle, and removable for dispensing toner to a copier.

The present invention will now be further described by reference to the following drawings which are not to be deemed limitative in any manner thereof.

FIG. 10A is a perspective view of a toner dispensing device in accordance with one aspect of the present invention, the tray being in an extended position;

FIG. 10B is a perspective view of the toner dispensing device of FIG. 10A, the tray being in an operative position;

The same numerals are used throughout the various figures of the drawings to designate similar parts.

Figures 1A, 3:
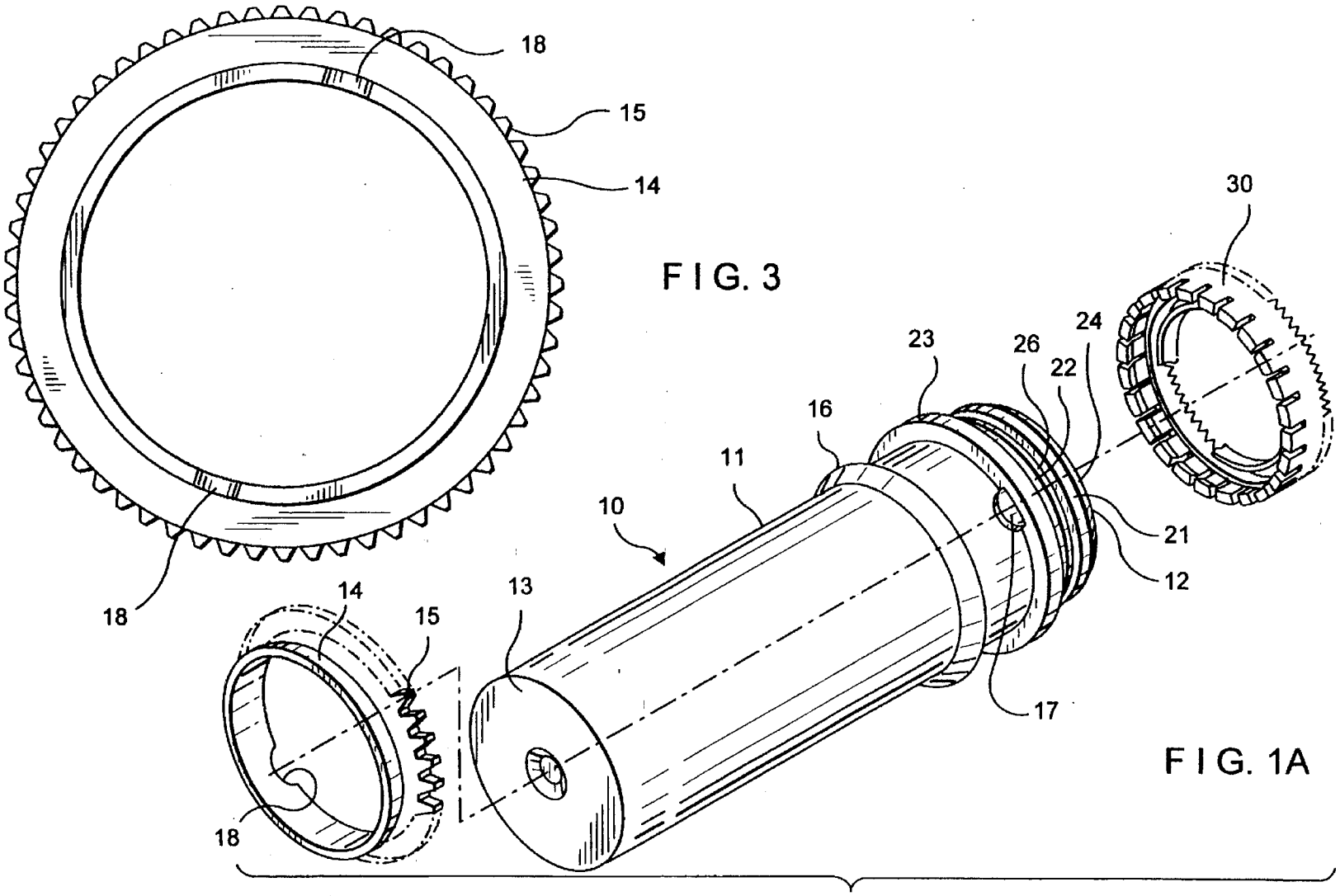
FIG. 1A is an exploded perspective view of an article for dispensing toner and the like, in accordance with one aspect of the present invention.
FIG. 3 is an enlarged plan view of the article collar of FIG. 1A.

Still other objects and advantages of the present invention will become apparent from the following description of the preferred embodiments.

FIGS. 1A–16 show generally a specific, illustrative article 10 for dispensing toner and the like, in accordance with the present invention. The article, e.g., a toner canister, comprises a cylindrical housing 11 with an open end 12 and a closed end 13, the open end engaging a flanged collar 14 adjacent thereto. The collar has teeth 15 extending radially therefrom for operatively engaging a worm gear 74 of a toner dispensing device 40 and, upon such engagement, enabling rotation of the canister. The canister open end further comprises a lip 25 and flange portions 20 for snapping engagement with a ring 30.

Figure 5A:
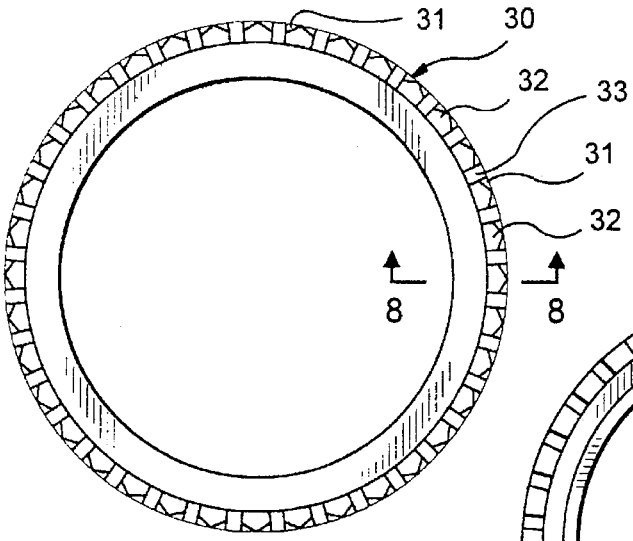
FIG. 5A is an enlarged plan view of the article ring of FIG. 1A.
Figure 5B:
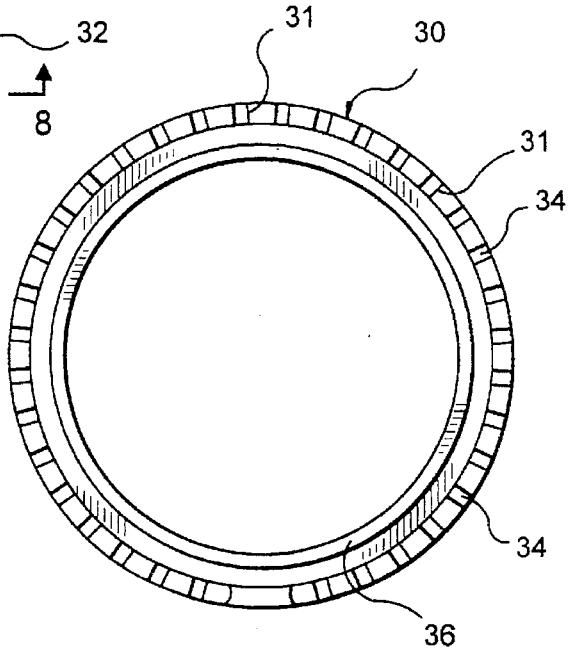
FIG. 5B is a reverse plan view of the ring of FIG. 5A.

The ring preferably has a plurality of slots 31, e.g., 36 slots or one for every 10° of ring circumference, as best seen in FIG. 5B. This slot arrangement permits ready expansion of the ring and engagement with the lip and flange portions. Each slot is suitably dimensioned, e.g., from about 0.200 inch to about 0.250 inch long and from about 0.025 inch to about 0.040 inch wide, for ready engagement with the canister.

Figure 9A:
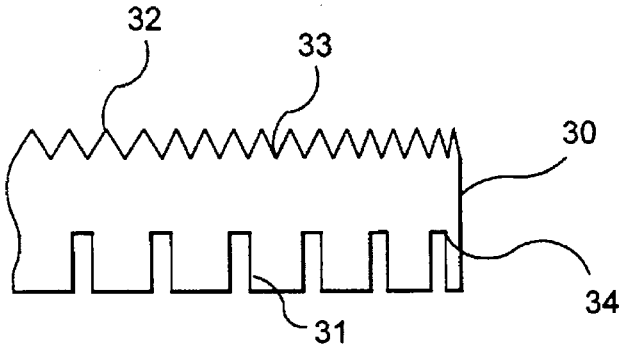
FIG. 9A is an enlarged side view of the ring of FIG. 5A showing the teeth and slot arrangement.
Figure 9B:
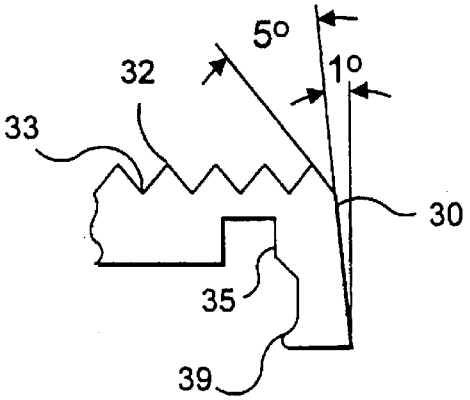
FIG. 9B is an enlarged cut-away view of the ring of FIG. 9A showing the teeth and hook-like element.
Figure 9C:
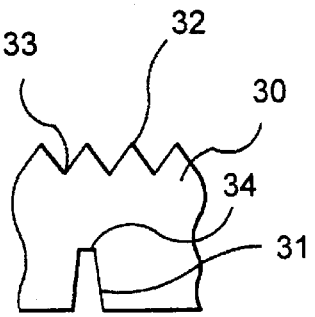
FIG. 9C is an enlarged cut-away view of a ring slot in accordance with another aspect of the present invention.
Figure 11A:
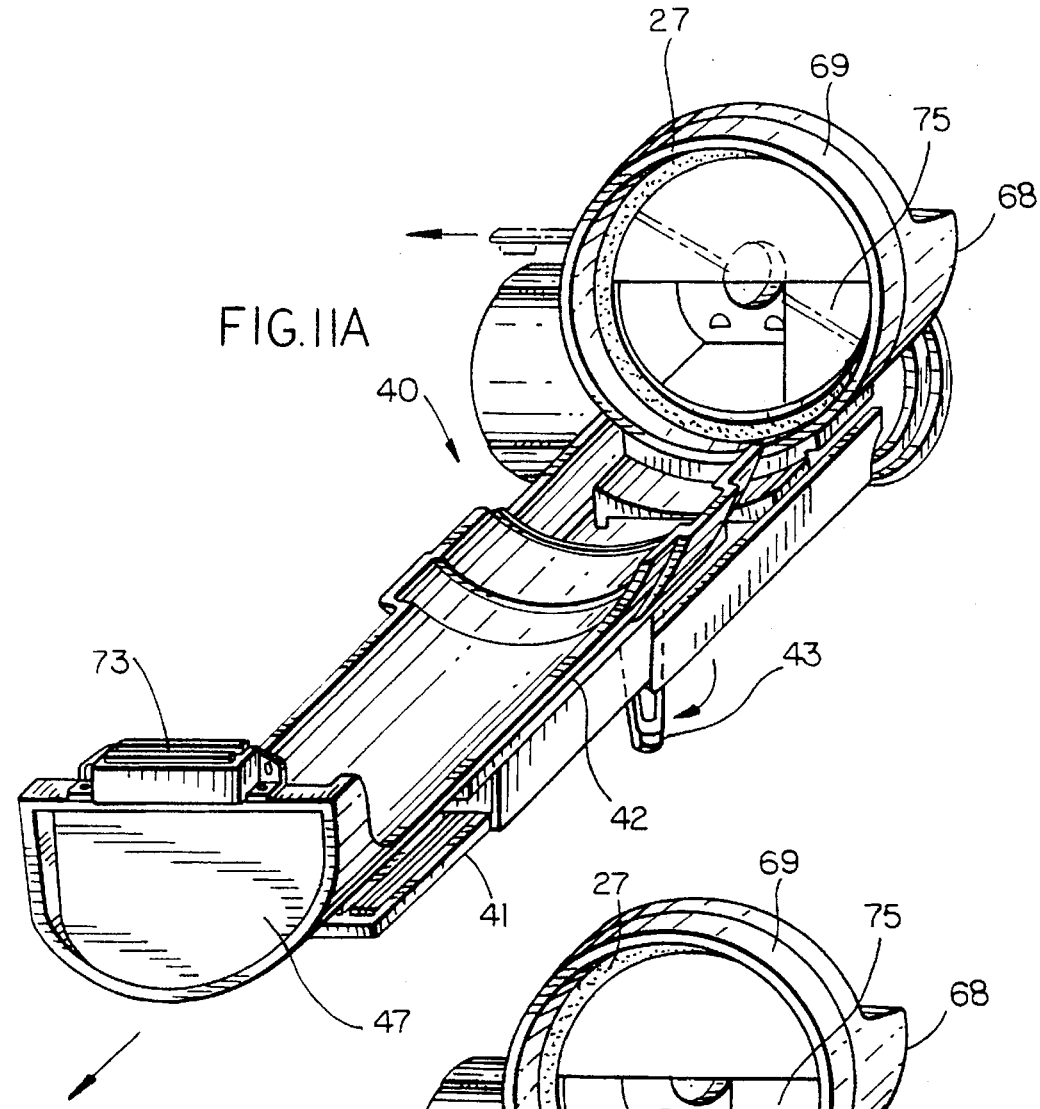
FIG. 11A is a perspective view of a toner dispensing device in accordance with another aspect of the present invention, the tray being in an extended position.
Figure 11B:
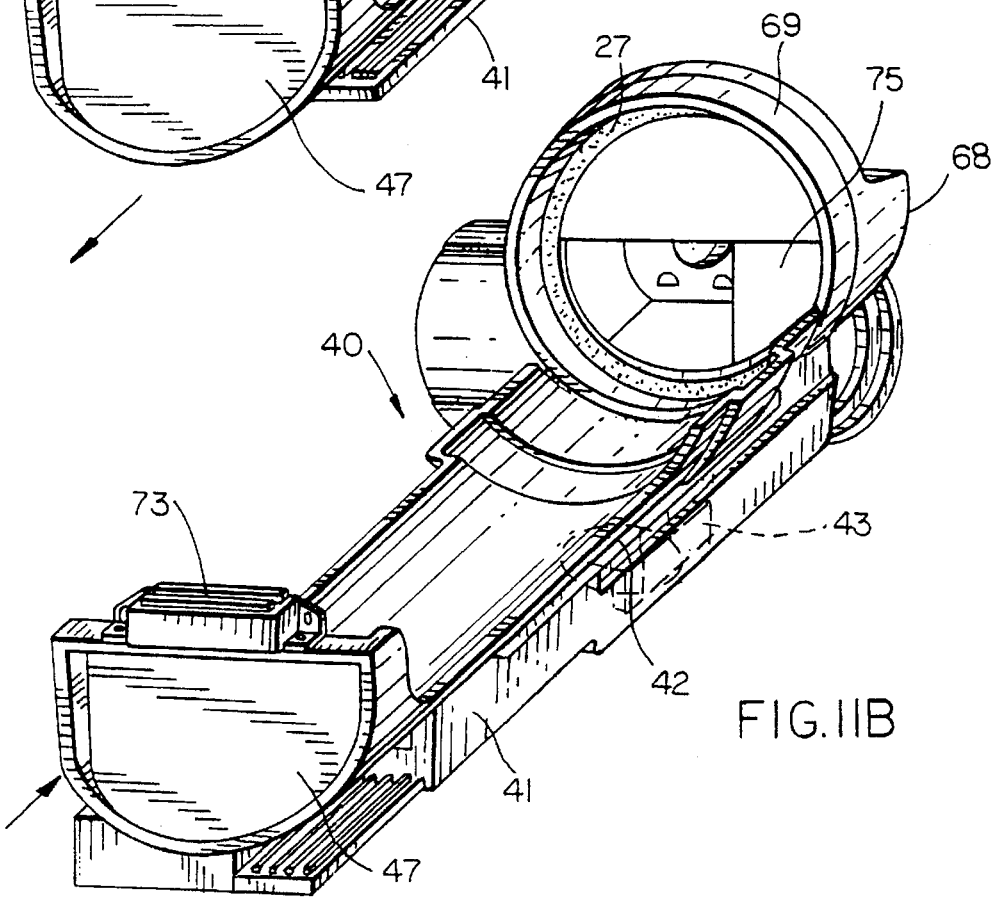
FIG. 11B is a perspective view of the toner dispensing device of FIG. 11A, the tray being in an operative position.
Figure 12A:
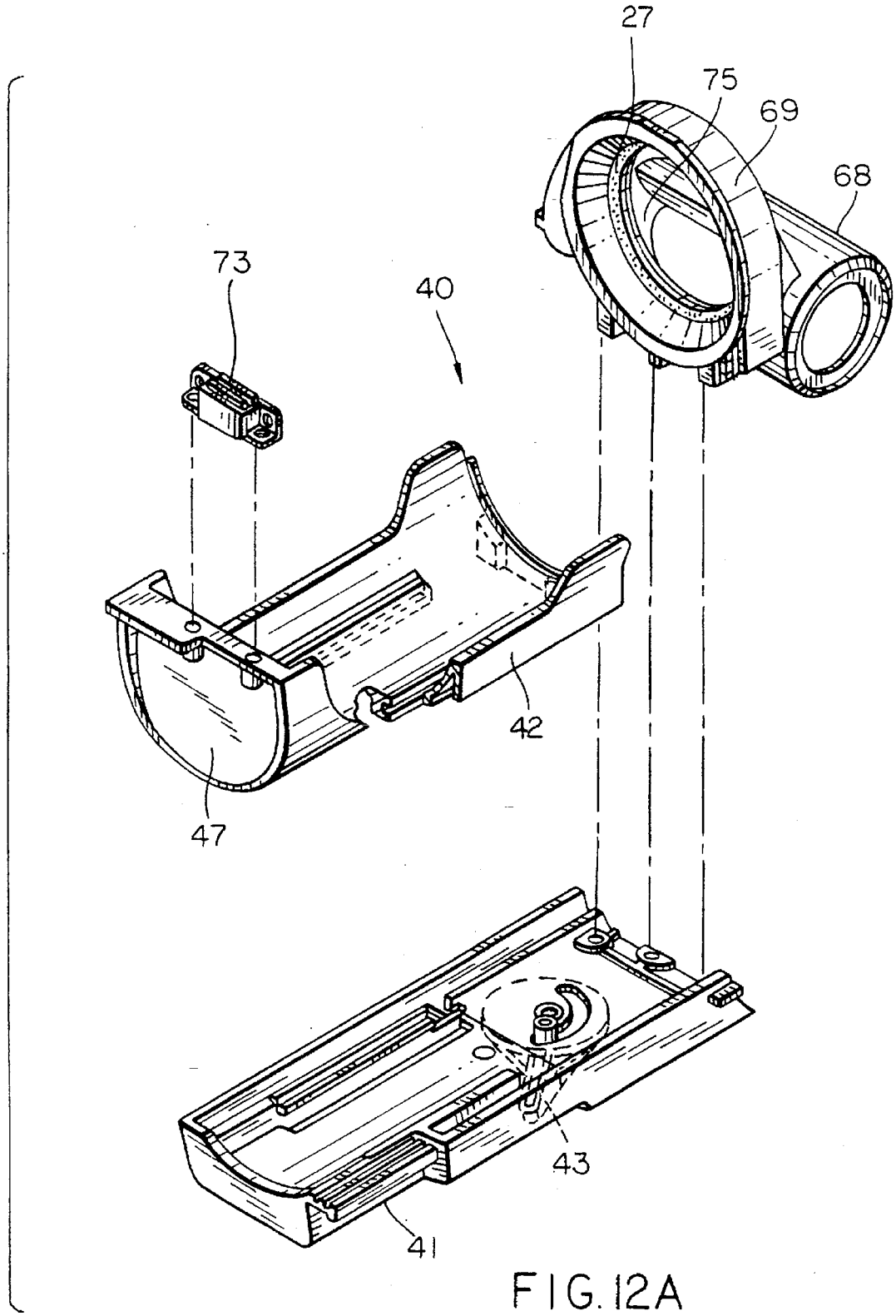
FIG. 12A is an exploded perspective view of the device of FIG. 10A.
Figure 12B:
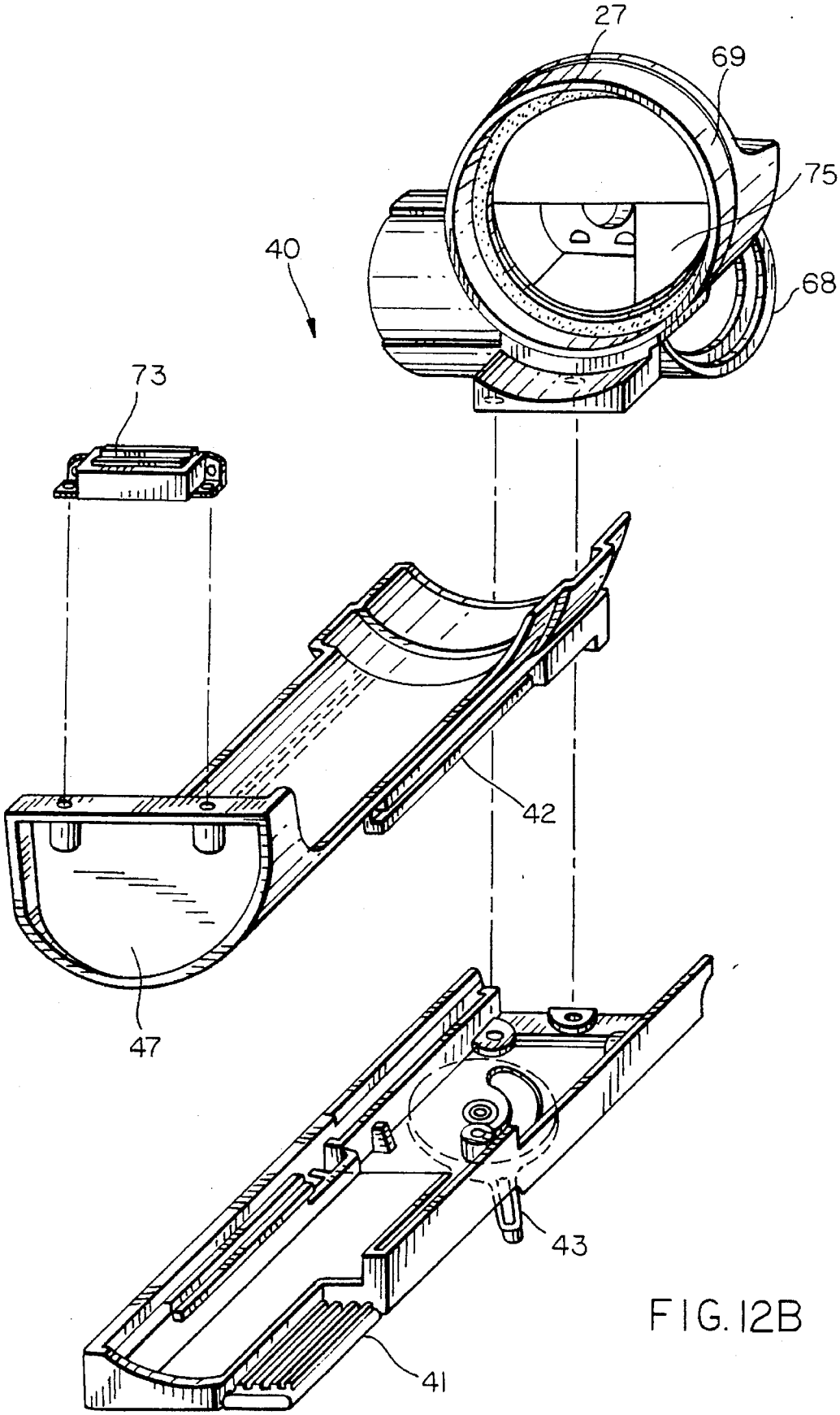
FIG. 12B is an exploded perspective view of the device of FIG. 11A.

Alternatively, as shown in FIG. 9C, the slots are tapered, each slot, e.g., being about 0.225 inch long and about 0.025 inch wide, tapering to between about 0.030 and about 0.040 inch. This taper, it has been found, facilitates release of the ring from its mold during manufacture, thereby prolonging mold life. In another alternative embodiment, the plurality of slots comprise selected tapered and untapered configurations. In still another embodiment, no slots are provided in the ring.

Outwardly facing portions of the ring are preferably tapered, as shown, for instance, in FIG. 9B. A single continuous taper may be used, e.g., within a range of about 1° to about 5°, or two distinct tapered surfaces, e.g., each being within a range of about 1° to about 5° in any combination thereof.

Axially disposed teeth 32 are provided about the ring edges 33, preferably about 0.063 inch from the slot upper end 34. The teeth engage a cap-shaped receptacle 69 of toner dispensing device 40, limiting ring movement relative thereto while allowing rotation of the canister. This is advantageous since by avoiding rotational and sealing engagement of the canister within and relative to the cap-shaped receptacle, wear and tear of resilient ring 27 is reduced. Upon the canister's rotation relative to ring 30, toner may be dispensed therefrom.

Figure 7:
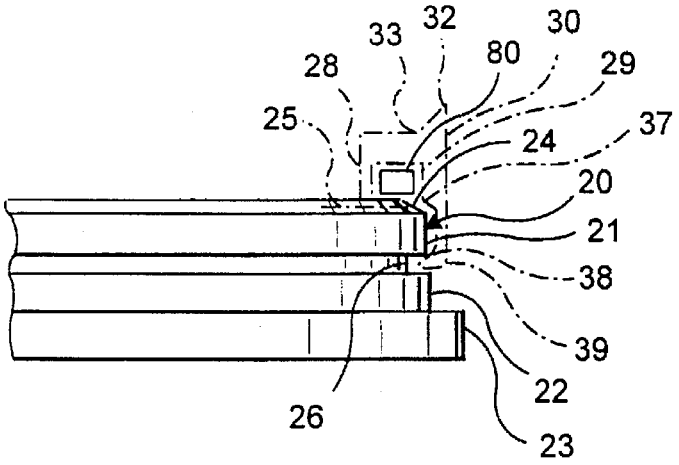
FIG. 7 is a cut-away side view of the article lip and flange portions of FIG. 2 showing the ring of FIG. 5A in phantom.

As best seen in FIG. 7, the lip and flange portions are suitably configured for snapping, loose-fit engagement with ring 30. For instance, the flanged portions are characterized by at least three flanges 21, 22, 23. The first flange 21 is adjacent the canister open end and has a chamfered leading edge 24 for sliding reception of the ring, the chamfer being, e.g., about 30° from the vertical axis. In accordance with one aspect of the present invention, the first flange is about 0.155 inch from the canister open end, and measures about 3.375 inches in diameter. The leading edge continues over the canister open end, defining lip 25.

Second flange 22 has a circumference substantially similar to that of the first flange and separated therefrom by a trough 26, e.g., about 0.091 inch wide. The second flange measures, e.g., about 0.077 inch in width and about 3.375 inches in diameter. Third flange 23 has a relatively larger circumference, e.g., about 3.5 inches in diameter.

Figure 8:
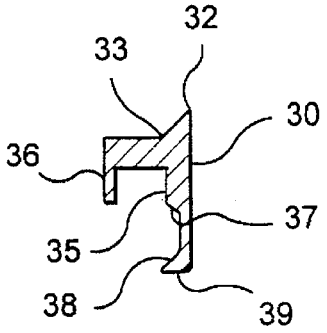
FIG. 8 is a sectional view taken along line B—B of FIG. 5A.

Upper and interior edges 28, 29, respectively, of ring 30 are configured for cooperative engagement with the first and second flanges, the trough, and the lip. As shown in FIGS. 7 and 8, ring 30 comprises a clamp-like fitting 35 having a lip 36 for wrapping around and engaging lip 25 of the canister. Portions 37, 38 of the fitting interior which engage the first flange are chamfered to facilitate a loose fit between the ring and the canister. Second chamfered portion 38 forms a hook-like element 39 which engages the trough, loosely securing the ring to the canister. This loose fit permits the hook-like element to slide freely between the first and second flanges. In this manner, rotation of the canister relative to ring 30 is facilitated.

For transporting the canister, a shipment ring 80 of a resilient material, e.g., felt, a polymeric material, or the like, may be positioned between the canister open end and ring 30, as shown in FIG. 7. This shipment ring, it has been found, hinders the passage of toner between the canister and ring 30 during transport, i.e., when the canister may be in unintended orientations for extended periods of time.

Although the present invention is shown and described having a hook and flange configuration for holding the ring on the canister and axially disposed teeth, other configurations may be used, giving consideration to the purpose for which the present invention is intended.

Figure 1B:
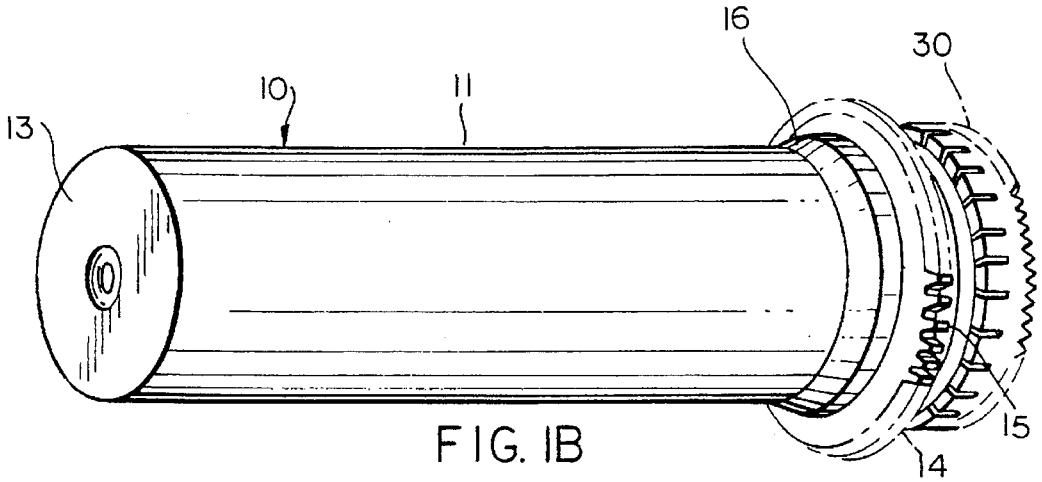
FIG. 1B is an intact perspective view of the article of FIG. 1A.
Figure 2:
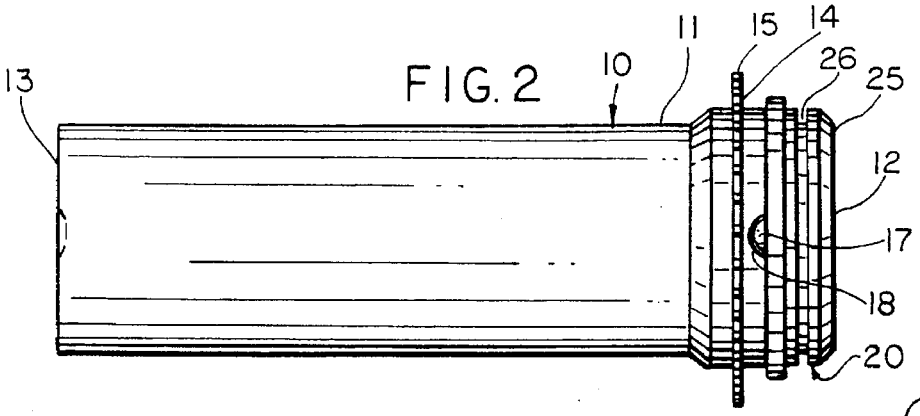
FIG. 2 is a side view of the article of FIG. 1A.
Figure 4:
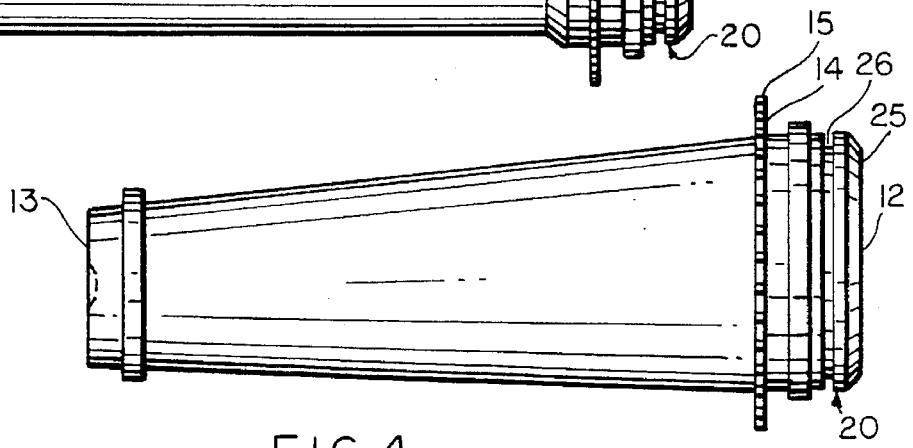
FIG. 4 is a side view of an article for dispensing toner and the like, in accordance with another aspect of the present invention.

Collar 14 is a ring-like piece which fits snugly onto the canister, as shown in FIGS. 1A and 1B. The collar is mounted by simply sliding it over the closed end of the canister and along the canister body. Upon nearing the canister open end, the collar rides up and over a ramp 16 formed on the canister housing, snapping into position. Tabs 17 on opposing sides of the canister, upon engagement with semicircular detents 18 in the third flange, limit rotation of the collar about the canister. The third flange serves as a stop for abutting the collar, i.e., to limit its longitudinal movement along the canister. Upon snapping into position, collar 14 remains permanently affixed to the canister in this embodiment and is not to be removed. Alternatively, as shown in FIG. 4, the collar is formed integrally with the canister and the sides of the canister are tapered, e.g., within a range of about 1° to about 10°.

Figure 6A:
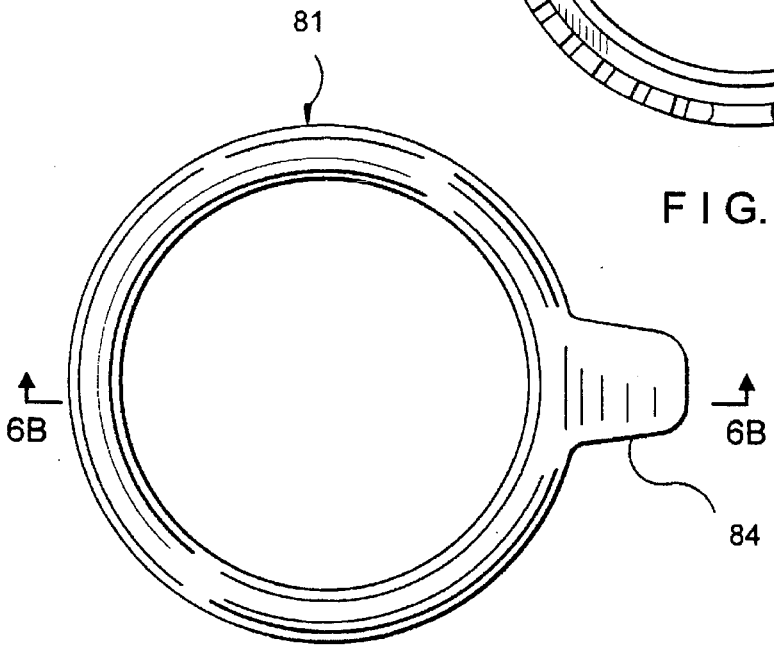
FIG. 6A is a plan view of a cap for the article, in accordance with one aspect of the present invention.
Figure 6B:
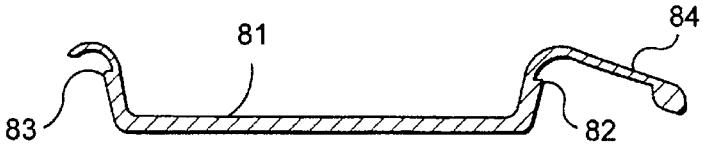
FIG. 6B is a sectional view taken along line A—A of FIG. 6A.

To store the canister, a cap 81, as shown in FIGS. 6A and 6B, is preferably mounted at the canister open end, inside ring 30. The cap is secured to the canister by snaps 82, 83. Pull-tab 84 allows a user to remove the cap for installation of the canister in a copier.

Ring 30 and collar 14 are desirably made of a polymeric material, such as a high impact polystyrene known as "HIPS". Preferably, both the canister and its cap are constructed of polypropylene or the like. The canister may be transparent, translucent, or opaque, giving consideration to the purpose for which the present invention is intended.

Referring now to FIGS. 10A–16, there is shown a specific:, illustrative toner dispensing device 40 for transporting toner contained in the canister to a developing device or toner storage area of an electrophotographic copier.

Figure 16:
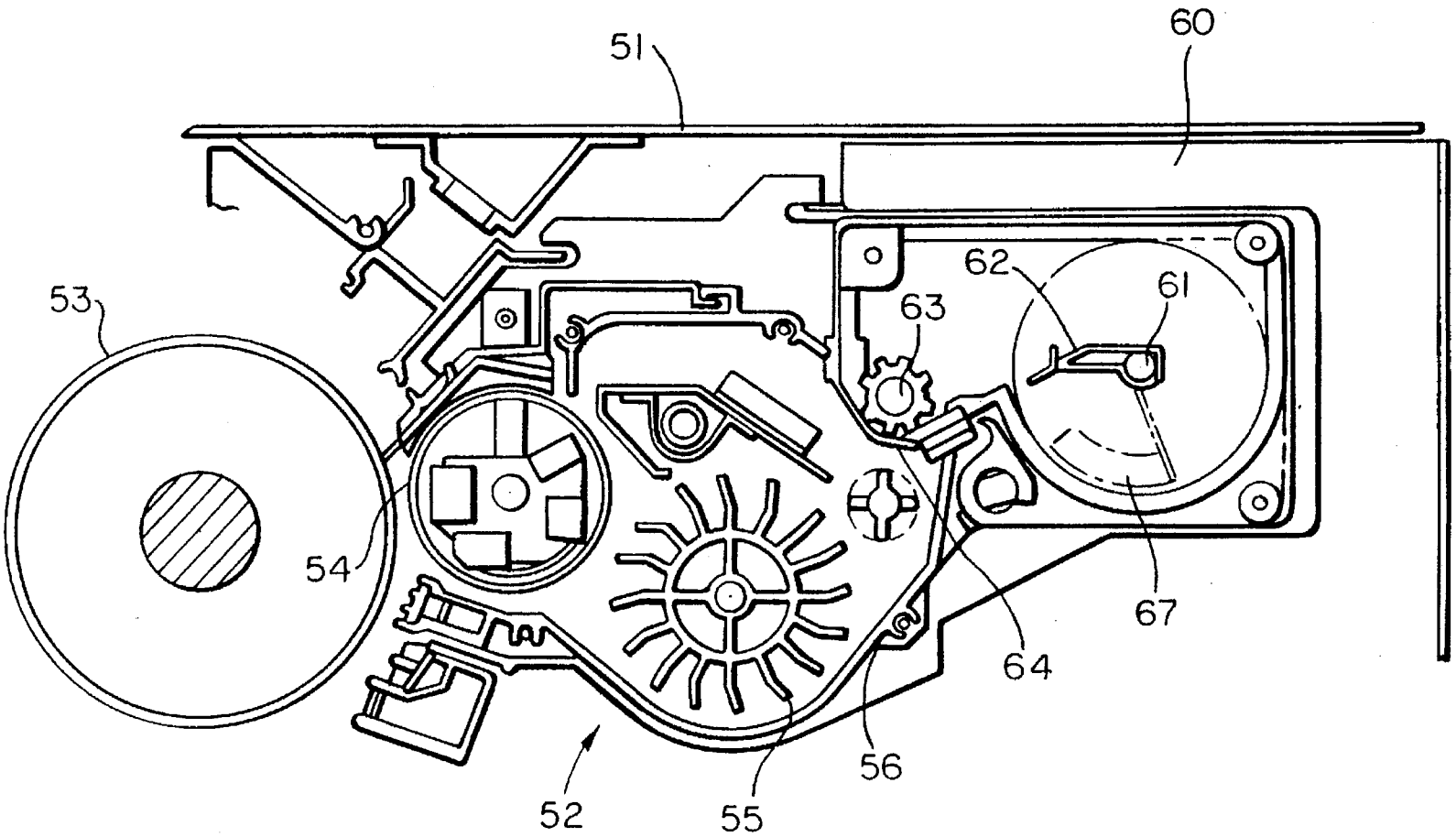
FIG. 16 is a schematic illustration showing the structure of an electrophotographic copier with a toner dispensing device according to one aspect of the present invention.

Inside housing 51 of the copier is a developing device 52 adjacent a photosensitive drum 53 on which an electrostatic latent image is developed, as shown in FIG. 16. A developing roller 54 is rotatably supported and disposed adjacent to the drum. An impeller 55 (which is rotatably driven by the developing roller) transports toner to the roller. The casing 56 of the developing device has a toner reservoir which temporarily stores fresh toner for supply to the developing roller.

Figure 13:
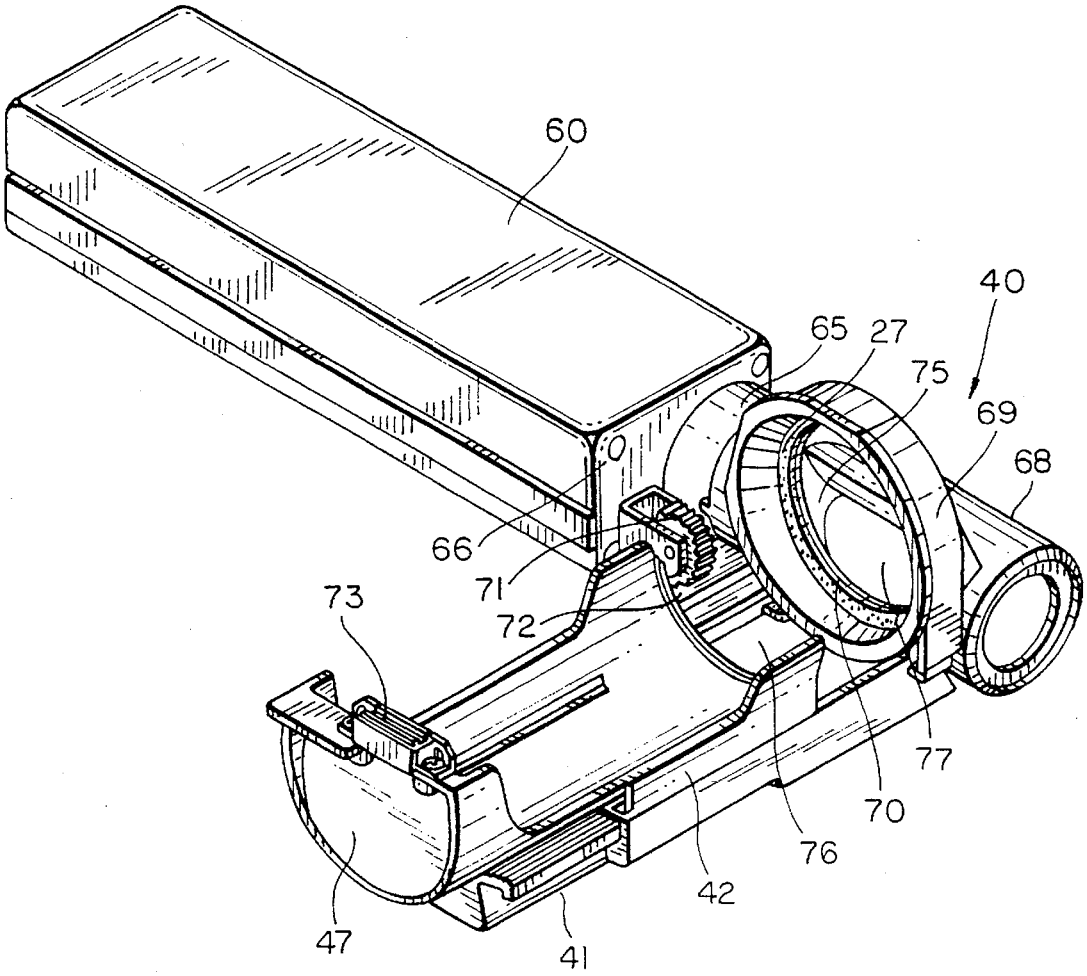
FIG. 13 is a perspective view of the toner dispensing device of FIG. 10A mounted to a toner storage container.

As shown in FIG. 13, an elongated toner storage container 60 is located adjacent the developing device. A shaft 61 extends through the container and has an agitator 62 for stirring toner contained therein. A toner supply roller 63 at supply port 64 is in communication with the developing device interior and is driven to rotate in accordance with a signal supplied from a toner density detector (not shown).

The toner dispensing device is provided at one end of the storage container and configured to detachably secure a canister for dispensing toner when the device and canister are in an operative position, e.g., about a 1°–2° tilt from horizontal. The canister is then rotated in association with the toner supply roller to dispense toner from the container to the developing device.

Lining (and encircling) the exit from the dispensing device is a resilient ring 27, e.g., of felt, polymeric foam, or the like. Upon positioning the canister in the device and ring 30 in the receptacle, the canister may be rotated readily relative to ring 30 without rotation of ring 30 relative to the receptacle and its resilient ring. This results in minimal wear of the resilient ring. In this connection, the configuration of ring 30 also minimizes spillage of toner during the canister's removal. For instance, toner which cakes about the ring lip falls inside the canister upon its removal rather than onto the dispensing device and into the copier. This substantially eliminates delay from clean-up after changing toner canisters.

Figure 14:
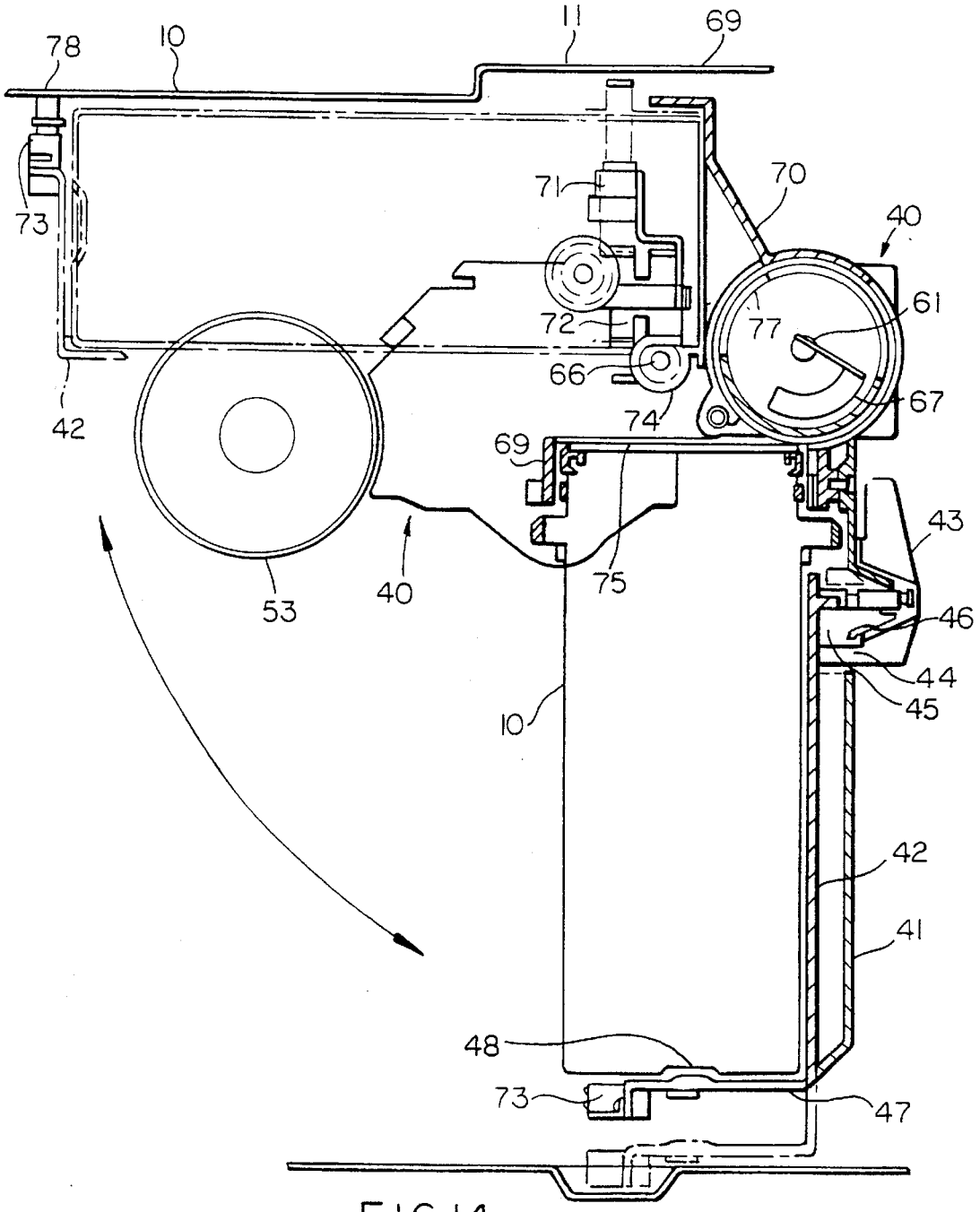
FIG. 14 is a schematic illustration showing the structure of the toner dispensing device of FIG. 10A and associated apparatus.
Figure 15:
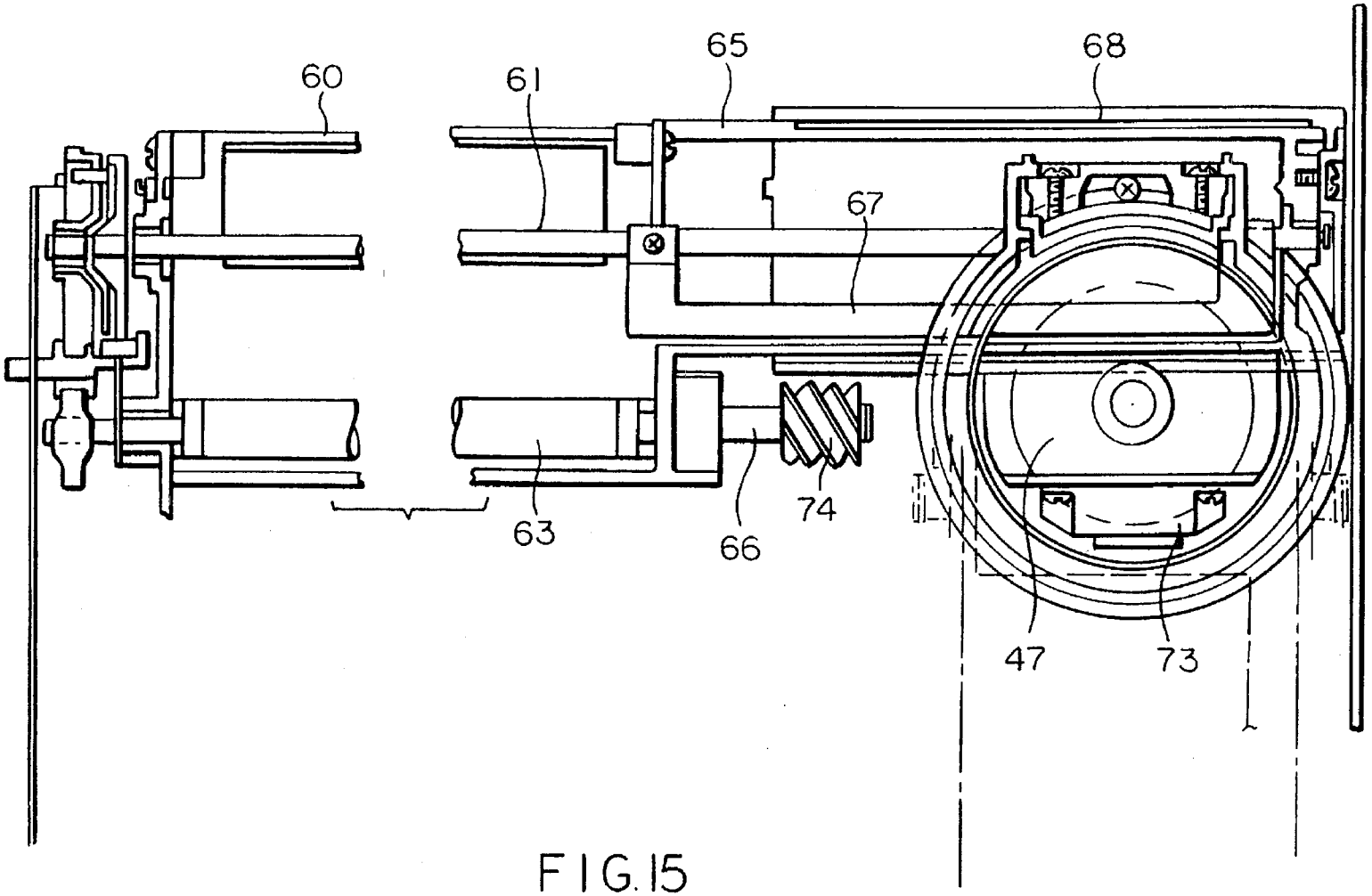
FIG. 15 is a plan view of the structure shown in FIG. 14.

On the operative side of the toner storage container, a cylinder member 65 projects from an end plate 66, and a shaft 61, which extends through the toner storage container, further extends through the cylinder member. As shown in FIGS. 14 and 15, the shaft is provided with a toner transport mechanism such as plate 67 for transporting the toner supplied into the cylinder member through an opening 77 formed in the peripheral wall of the cylinder member, and into the toner storage container. A supporting sleeve 68 is rotatably fit onto the cylinder member.

Integrally provided with the device is cap-shaped receptacle 69 in which ring 30 may be received. The receptacle is provided with an opening 70 which comes into alignment with the cylinder member opening when the supporting sleeve is rotated relative to the cylinder member so as to locate the receptacle horizontally. Upon such alignment, a mouth piece 75 associated with the dispensing device is in proximity to ring 30. The mouth piece is suitably configured for controlling the discharge flow of toner from the canister.

A canister support arm 41 is secured to the receptacle by suitable fasteners, e.g., screws, the canister being held in position by a tray or holder 42. The holder has a bottom plate 47 abutting a bottom central portion 48 of the canister.

At the bottom of the support arm is a pivotal knob 43. An integral pin 44 of the knob projects through an arc-shaped slot. 45 formed in the support arm such that the pin is in engagement with an engaging plate 46 integrally provided on the holder. Accordingly, by pivoting the knob, the holder is movable along its longitudinal axis relative to the support arm.

In addition, a pinion 71 is rotatably supported on the end surface of the toner storage container, and brought into mesh with the collar when the support arm is rotated to a horizontal or operative position. Rotation of the pinion is accomplished through a driving force transmitted from worm gear 74 which is located at the tip end of the toner supply roller shaft. The roller shaft extends beyond the end wall of the toner storage container by way of an idler gear 72. The teeth of the collar are brought into mesh with the pinion upon locating the canister in the operative position, e.g., about a 1°–2° tilt from the horizontal position. The canister is then rotated synchronously with the toner supply roller to dispense the toner.

To locate the support arm at a position suitable for canister removal, it is rotated counterclockwise around the cylinder member. The knob is then rotated in order to move the holder downward to a lower position designated generally by the two-dotted line, as shown in FIG. 14. The canister received in the holder may then be pulled out of the receptacle and removed from the holder. After the canister has been recharged or a new canister obtained, it is inserted into the holder such that the canister open end fits into the receptacle. When the knob is rotated back to its original position, the canister is locked in position.

Then, the support arm is rotated clockwise over 90° to bring magnet 73 into contact with a magnetically attractable element 78 mounted to the housing. This permits the support arm and thus the canister to be held relatively horizontally. When so located, the collar teeth are brought into mesh with the pinion and, moreover, the opening of the cap-shaped receptacle comes into alignment with the opening of the cylinder member. This allows toner in the canister to be supplied through the cylinder member and into the storage container.

In accordance with one aspect of the present invention, upon securing the canister in the holder, a gap 76 is formed between the holder bottom and the canister engaging portion of the device. This gap receives the collar of the canister and allows its unobstructed rotation.

Upon repeated photocopy operations, toner density within the developing device decreases. When a toner density detector (not shown) senses this decrease, an electromagnetic clutch (also not shown) is signaled to begin rotation of the toner supply roller on the shaft. In association therewith, the worm gear (also mounted on the shaft) begins rotating which, in turn, causes the canister to rotate to dispense toner through the aligned openings, and into the cylinder member. Toner transport plate 67 then transports the toner further, into the storage container. This process continues until the toner supply roller stops, i.e., when the toner density within the developing device reaches a predetermined value.

Although the canister and dispensing device are shown and described at a selected inclination, e.g., a 1°–2° tilt, it will be appreciated that their orientation and the manner of their movement may be varied depending upon flow properties of the toner and/or other factors. Also, while the canister illustrated is generally cylindrical in shape, it will be understood that other canister configurations and/or geometries may be appropriate, giving consideration to the purpose for which the present invention is intended.

Since from the foregoing the construction and advantages of the invention may be readily understood, further explanation is believed unnecessary. However, since numerous modifications will readily occur to those skilled in the art after consideration of the foregoing specification and accompanying drawings, it is not intended that the invention be limited to the exact construction shown and described, but all suitable modifications and equivalents may be resorted to which fall within the scope of the appended claims.

What is claimed is:

1. An article for dispensing toner and the like to an electrophotographic copier, the article comprising a generally cylindrical housing with an open end and a closed end, the open end having a flanged collar adjacent thereto, the collar having outwardly extending teeth for enabling the article's rotation upon driving engagement with a dispensing device of the copier, the article open end further comprising a lip and flange portions which loosely secure a ring thereto, the ring having edges configured for engaging a receptacle of the dispensing device so as to limit ring movement relative to the receptacle, while allowing rotation of the article, the ring also having lip portions configured for minimizing spillage of toner upon removal of the article from the receptacle.

2. The article set forth in claim 1 wherein the ring edges are serrated so as to limit ring movement upon engagement with the receptacle.

3. The article set forth in claim 1 wherein the flange portions comprise at least two flanges defining a trough therebetween.

4. The article set forth in claim 3 wherein the ring further includes a hook-like member for engaging the trough and retaining the ring on the article.

5. The article set forth in claim 1 wherein the ring further includes a plurality of slots about the circumference thereof.

6. The article set forth in claim 5 wherein each slot has a selected taper.

7. A method of dispensing toner and the like to an electrophotographic copier, the method comprising the steps of:

providing an article having a generally cylindrical housing with an open end and a closed end, the open end having a flanged collar adjacent thereto, the collar including outwardly extending teeth for enabling rotation of the article upon driving engagement with a dispensing device of the copier, the housing containing a selected volume of toner;

providing a ring in engagement with the open end of the housing, the article open end further comprising a lip and flange portions configured for loosely securing the ring thereto, the ring having serrated edges in engagement with a receptacle of the dispensing device and limiting movement of the ring relative to the receptacle, while allowing rotation of the article, the ring also having lip portions configured for minimizing spillage of toner upon removal of the canister from the receptacle;

rotating the housing so as to dispense the selected volume of toner; and upon delivering substantially the selected volume of toner to the copier, removing the housing from the receptacle.

8. The method set forth in claim 7 wherein a storage cap is removed from the article open end prior to engagement with the receptacle.

9. In combination, a toner dispensing device and article for dispensing toner to an electrophotographic copier, the article comprising a generally cylindrical housing with an open end and a closed end, the open end having a flanged collar adjacent thereto, the collar having outwardly extending teeth for enabling the article's rotation upon driving engagement with a dispensing device of the copier, the article open end further comprising a lip and flange portions which loosely secure a ring thereto, the ring having edges configured for engaging a receptacle of the dispensing device so as to limit ring movement relative to the receptacle, while allowing rotation of the article, the ring also having lip portions configured for minimizing spillage of toner upon removal of the canister from the receptacle.

10. The article set forth in claim 9 wherein the ring edges are serrated so as to limit ring movement upon engagement with the receptacle.

11. The article set forth in claim 9 wherein the flange portions comprise at least two flanges defining a trough therebetween.

12. The article set forth in claim 11 wherein the ring further includes a hook-like member for engaging the trough and retaining the ring on the article.

13. The article set forth in claim 9 wherein the ring further includes a plurality of slots about the circumference thereof.

14. The article set forth in claim 13 wherein each slot has a selected taper.

* * * * *